US010149501B2

(12) United States Patent
Matsen

(10) Patent No.: US 10,149,501 B2
(45) Date of Patent: Dec. 11, 2018

(54) GARMENTS TO AID INFANTS IN ACHIEVING STABLE QUADRUPED POSTURE AND CONTROLLED MOBILITY

(71) Applicant: Megan E. Matsen, Millbrook, NY (US)

(72) Inventor: Megan E. Matsen, Millbrook, NY (US)

( * ) Notice: Subject to any disclaimer, the term of this patent is extended or adjusted under 35 U.S.C. 154(b) by 100 days.

(21) Appl. No.: 14/299,935

(22) Filed: Jun. 9, 2014

(65) Prior Publication Data

US 2015/0351461 A1 Dec. 10, 2015

(51) Int. Cl.

| | |
|---|---|
| ***A41D 11/00*** | (2006.01) |
| ***A41B 13/00*** | (2006.01) |
| *A41D 1/06* | (2006.01) |

(52) U.S. Cl.

CPC ..... *A41B 13/005* (2013.01); *A41B 13/00* (2013.01); *A41D 11/00* (2013.01); *A41D 1/067* (2013.01)

(58) Field of Classification Search

CPC .... A41D 11/00; A41D 13/015; A41D 13/065; A41D 13/0587; A41B 13/005; A41B 13/04; A63B 71/1225

USPC ..... 2/79, 80, 77, 16, 22, 23, 24, 108, 115, 2/125, 69

See application file for complete search history.

(56) References Cited

U.S. PATENT DOCUMENTS 3,411,222 A * 11/1968 Williams ..... A63B 23/0355 2/24
3,991,420 A * 11/1976 Savarino ..... A41D 13/0153 2/16
4,024,584 A * 5/1977 Smith ..... A41D 13/065 2/22
4,035,844 A * 7/1977 Atack ..... A41D 1/08 2/22
4,484,360 A * 11/1984 Leighton ..... A63B 71/1225 2/22
D307,505 S * 5/1990 Schiff ..... D2/712
5,134,726 A * 8/1992 Ross ..... A41D 1/08 2/22

(Continued)

FOREIGN PATENT DOCUMENTS

GB 2199233 A * 7/1988 ..... A41D 13/00
GB 2506629 A * 4/2014 ..... A41B 13/00

(Continued)

OTHER PUBLICATIONS

"Discrete."Merriam-Webster. Merriam-Webster, Web. Mar. 24, 2017.*

*Primary Examiner* — Tejash Patel
(74) *Attorney, Agent, or Firm* — Law Offices of Michael L. Wise, LLC

(57) ABSTRACT

Aspects of the invention are directed to a garment for use by a wearer positioned on a ground surface. The garment comprises pants, a plurality of left pant patches, and a plurality of right pant patches. The pants have a left pant half and a right pant half. Each of the plurality of left pant patches overlies a respective portion of the left pant half, is elongate, and is characterized by a coefficient of static friction with the ground surface greater than that for the respective portion of the left pant half underlying it. Moreover, each of the plurality of right pant patches overlies a respective portion of the right pant half, is elongate, and is also characterized by a coefficient of static friction with the ground surface greater than that for the respective portion of the right pant half underlying it.

15 Claims, 6 Drawing Sheets

(56) References Cited

U.S. PATENT DOCUMENTS 5,592,689 A * 1/1997 Matthews ..... A41B 13/00 2/23
5,659,895 A * 8/1997 Ford, Jr. ..... A62B 17/008 2/2.11
5,845,335 A * 12/1998 Twitty ..... A41D 11/00 2/125
6,009,565 A * 1/2000 Carrington ..... A41D 13/015 2/227
6,484,319 B1 * 11/2002 Fusco ..... A41D 7/00 2/67
6,708,342 B2 * 3/2004 Boersema ..... 2/69
6,729,164 B2 * 5/2004 Shibata ..... A41B 11/02 2/22
7,062,789 B1 * 6/2006 Blackwell ..... A41D 1/08 2/79
D535,808 S * 1/2007 Beland ..... D2/840
7,296,301 B1 * 11/2007 Conn ..... A41D 13/065 2/23
D590,998 S * 4/2009 Feeley ..... D29/121.1
7,748,056 B2 * 7/2010 Mickle ..... A41D 13/0518 2/115
D674,576 S * 1/2013 Johnson ..... D2/840
8,438,669 B2 * 5/2013 Turner ..... A41D 13/05 2/22
8,667,613 B2 * 3/2014 Blakely ..... A41D 13/08 2/16
D728,899 S * 5/2015 Bates ..... D2/745
9,066,544 B1 * 6/2015 Neftin ..... A41B 13/00
2002/0026664 A1 * 3/2002 Grounds ..... A41D 13/012 2/465
2003/0000003 A1 * 1/2003 Boersema ..... A41B 11/008 2/69
2003/0046747 A1 * 3/2003 Berns ..... A41D 13/0153 2/69
2004/0019950 A1 * 2/2004 Rast ..... A41D 13/0158 2/77
2004/0158910 A1 * 8/2004 Bay ..... A41D 3/00 2/69
2005/0060782 A1 * 3/2005 Sallas ..... A41D 11/00 2/23
2005/0229282 A1 * 10/2005 Davis ..... A41D 13/0575 2/69
2007/0150994 A1 * 7/2007 Matuszak ..... A41D 13/065 2/24
2008/0313793 A1 * 12/2008 Skottheim ..... A41D 13/0153 2/461
2009/0013442 A1 * 1/2009 Matuszak ..... A41D 13/065 2/23
2009/0013451 A1 * 1/2009 Baxter ..... A41B 9/001 2/455
2009/0144873 A1 * 6/2009 Jewell ..... A41D 13/0581 2/24
2010/0064415 A1 * 3/2010 Melhart ..... A41D 13/0015 2/125
2010/0229278 A1 * 9/2010 Bates ..... A41D 13/0002 2/115
2010/0319104 A1 * 12/2010 Beland ..... A41D 13/0015 2/125
2012/0005797 A1 * 1/2012 Cotsoglou ..... A41D 13/05 2/16
2012/0210487 A1 * 8/2012 Albin ..... A41D 13/0015 2/69
2012/0216327 A1 * 8/2012 Turner ..... A41D 13/0156 2/69
2012/0255105 A1 * 10/2012 Turner ..... A41D 13/0506 2/455
2012/0260391 A1 * 10/2012 Davtyan ..... A41D 13/0537 2/22
2012/0284908 A1 * 11/2012 McCredy ..... A41D 13/05 2/459
2013/0025036 A1 * 1/2013 Turner ..... A42B 3/125 2/455
2013/0111646 A1 * 5/2013 Sevenants ..... A41D 1/08 2/69
2013/0152268 A1 * 6/2013 Langdon ..... A41B 13/00 2/80
2013/0254967 A1 * 10/2013 Tiemann ..... A41D 13/0015 2/69
2013/0283511 A1 * 10/2013 Diamond ..... A63B 71/12 2/455
2014/0000004 A1 * 1/2014 Baron ..... A41B 1/00 2/69
2014/0020160 A1 * 1/2014 Ford ..... A41D 11/00 2/459
2014/0223630 A1 * 8/2014 Johnson ..... A41D 19/01547 2/69
2014/0259250 A1 * 9/2014 Strum ..... F41H 1/02 2/2.5
2014/0359912 A1 * 12/2014 Sutton ..... A63B 71/1225 2/16
2015/0000003 A1 * 1/2015 Blakely ..... A41D 13/08 2/69
2015/0101096 A1 * 4/2015 Turner ..... A41D 13/05 2/23
2015/0101110 A1 * 4/2015 Wagner ..... A41D 13/015 2/455

FOREIGN PATENT DOCUMENTS

WO WO 2005120262 A1 * 12/2005 ..... A41D 13/02
WO WO 2015067822 A1 * 5/2015 ..... A41B 13/00

* cited by examiner

Fig. 6
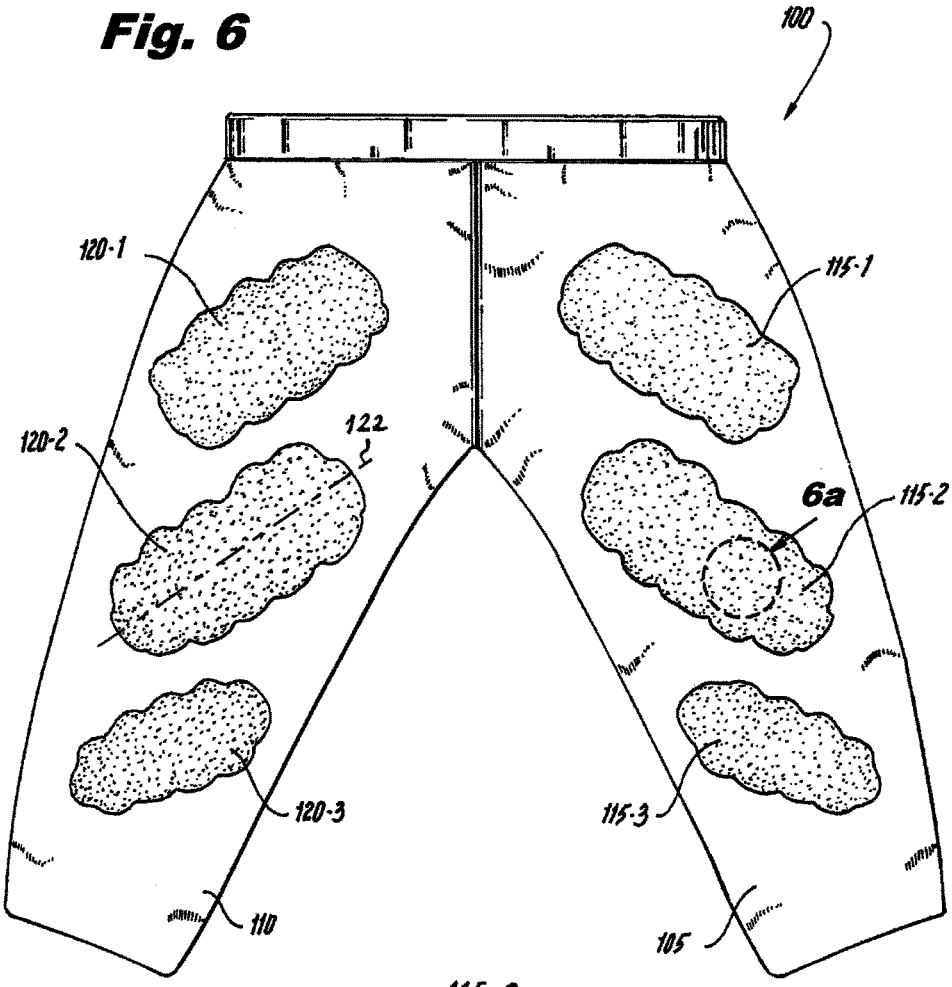
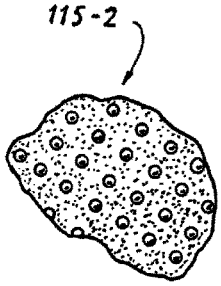
Fig. 6a

Fig. 8
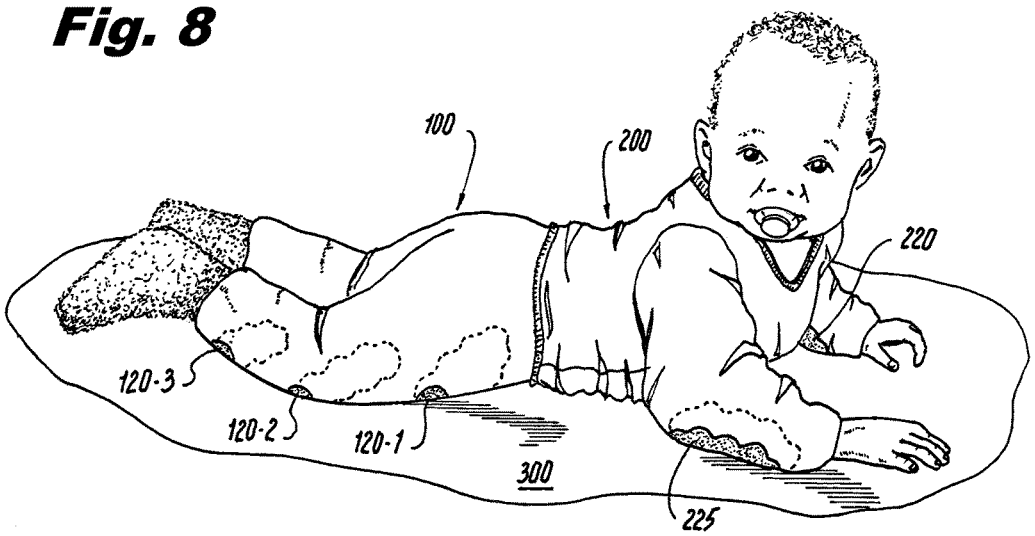
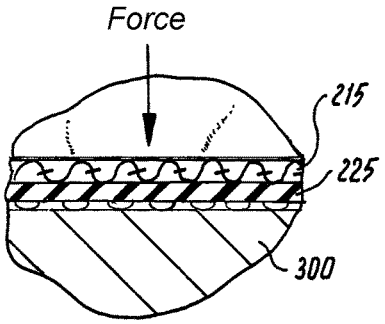
Fig. 9
Fig. 9a
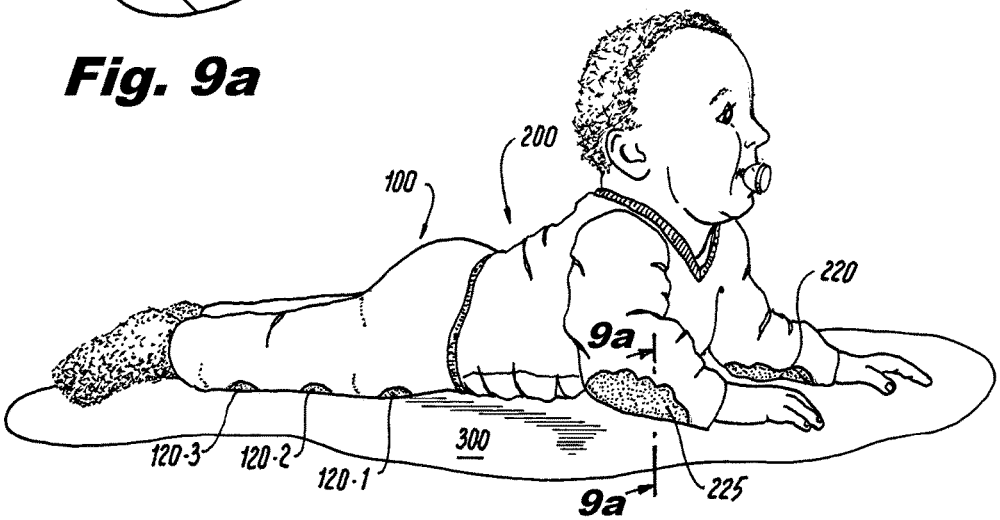

GARMENTS TO AID INFANTS IN ACHIEVING STABLE QUADRUPED POSTURE AND CONTROLLED MOBILITY

FIELD OF THE INVENTION

The present invention relates generally to garments for children, and, more particularly, to garments designed to aid infants in achieving stable quadruped postures necessary for crawling and creeping mechanics.

BACKGROUND OF THE INVENTION

Locomotion can be described as movement from one place to another. Crawling and creeping mechanics are essential in the overall development of early locomotion. Crawling can be defined as moving slowly by dragging the trunk (i.e., abdomen) and lower extremities along the ground. The defining component of crawling is that the child's belly is in contact with the floor. This is distinguished from creeping, which means to move across the floor on hands and knees without the trunk being in direct contact with the surface.

The transition from a prone to the quadruped posture typically occurs around six to seven months of age. FIGS. 1-4 show perspective views of an infant during this transition. In a first intermediate posture in FIG. 1, the infant's arms are extended before him and his arms, trunk and lower extremities are largely resting on the ground. The infant's forearms remain fully in contact with the floor surface, while he is bearing weight through his shoulders to his elbows. In a second intermediate posture in FIG. 2, the infant begins to extend his elbows and transfer upper extremity weight from forearms to hands so that his forearms begin to lift off the ground. Subsequently, in a third intermediate posture in FIG. 3, the infant begins to push his body posteriorly (i.e., in a backwards direction), raising the buttocks into the air while shifting his weight from his hips towards the knees. At the same time, the infant continues extending his arms at the elbows and transferring upper extremity weight from forearms to hands. Finally, in the quadruped posture shown in FIG. 4, the infant is bearing his weight on this hands and knees while maintaining hands under shoulders and knees under hips.

The quadruped posture requires the ability to maintain a steady position in a weight bearing, antigravity posture, and thus requires significant strength and stability at the hip and shoulder joints to maintain correct alignment and position. As a result, in early stages of learning to achieve this posture, an infant will often assume an "immature quadruped" posture during the transition. Such an immature quadruped posture is shown in the perspective view in FIG. 5. In this posture, the infant's hips are in external rotation and abduction (arrow), and his lower extremities are in poor weight bearing alignment (i.e., knees not under hips). The immature quadruped posture may be due to underdeveloped abdominal musculature as well as strong contraction of hip flexors in order to stabilize the posture. The splayed positioning of the immature quadruped posture aids stability, but interferes with locomotion.

Once stability is ultimately gained in the quadruped posture, the infant can begin to work on controlled mobility in efforts to creep with his hands and knees. Controlled mobility can be defined by the ability to alter a position or move in a weight bearing position while maintaining postural stability. Static-dynamic control is a prerequisite for the final skill stage of motor control. The process of weight shifting in various directions occurs in efforts to encourage forward and backward movement while on hands and knees. With controlled weight shifts, the child will typically rock forward and backward in efforts to lift one limb at a time, eventually lifting one upper extremity and the opposite lower extremity at once. This movement leads to creeping in the quadruped posture at approximately eight to ten months in typical development. Both the upper and lower extremities participate equally in creeping as the child advances in the direction of movement.

Unfortunately, both the transition from fully prone to quadruped, as well as early locomotion may be frustrated by environmental factors such as insufficient frictional coupling between the infant and the ground. Accordingly, there is a need for innovations that aid an infant in achieving a stable quadruped posture as well as developing controlled mobility with crawling and creeping mechanics, particularly on surfaces with low friction.

SUMMARY OF THE INVENTION

Embodiments of the present invention address the above-identified need by providing garments that aid the wearer in achieving a stable quadruped posture, as well as achieving controlled mobility by crawling and creeping.

Aspects of the invention are directed to a garment for use by a wearer positioned on a ground surface. The garment comprises pants, a plurality of left pant patches, and a plurality of right pant patches. The pants have a left pant half and a right pant half. Each of the plurality of left pant patches overlies a respective portion of the left pant half, is elongate, and is characterized by a coefficient of static friction with the ground surface greater than that for the respective portion of the left pant half underlying it. Moreover, each of the plurality of right pant patches overlies a respective portion of the right pant half, is elongate, and is also characterized by a coefficient of static friction with the ground surface greater than that for the respective portion of the right pant half underlying it.

Additional aspects of the invention are directed to a garment for use by a wearer positioned on a ground surface, the garment comprising pants, a plurality of left pant patches, a plurality of right pant patches, a shirt, a left shirt patch, and a right shirt patch. The pants have a left pant half and a right pant half. Each of the plurality of left pant patches overlies a respective portion of the left pant half, is elongate, and is characterized by a coefficient of static friction with the ground surface greater than that for the respective portion of the left pant half underlying it. Moreover, each of the plurality of right pant patches overlies a respective portion of the right pant half, is elongate, and is characterized by a coefficient of static friction with the ground surface greater than that for the respective portion of the right pant half underlying it. The shirt defines a left shirt sleeve and a right shirt sleeve. The left shirt patch overlies a portion of the left shirt sleeve, is elongate, and is characterized by a coefficient of static friction with the ground surface greater than that for the portion of the left shirt sleeve underlying it. The right shirt patch overlies a portion of the right shirt sleeve, is elongate, and is characterized by a coefficient of static friction with the ground surface greater than that for the portion of the right shirt sleeve underlying it.

BRIEF DESCRIPTION OF THE DRAWINGS

These and other features, aspects, and advantages of the present invention will become better understood with regard to the following description, appended claims, and accompanying drawings where:

FIG. 6 shows a front elevational view of pants in accordance with an illustrative embodiment of the invention;

FIG. 6*a* shows a magnified front elevational view of a portion of a middle left pant patch in FIG. 6;

FIG. 8 shows a perspective view of an infant in a first intermediate posture wearing the garments in FIGS. 6 and 7;

FIG. 9 shows a perspective view of an infant in a second intermediate posture wearing the garments in FIGS. 6 and 7;

FIG. 9*a* shows a sectional view of a portion of a shirt and a right shirt patch in FIG. 9 along the plane indicated in FIG. 9;

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

The directional terms "left" and "right," as used herein, are intended to define directions from the point of view of a human wearer of the garment under discussion. At the same time, the term "anterior" refers to the front of the wearer with the wearer in the standard anatomical position, while the "superior" direction is towards the head of the wearer and the "inferior" direction is towards the feet of the wearer while the wearer is in the standard anatomical position. The "medial" direction is towards the centerline of the wearer, while the "lateral" direction is towards a side of the wearer with the wearer in the standard anatomical position. The standard anatomical position has the human wearer standing erect, facing directly forward, feet pointed forward and slightly apart, and arms hanging down at the sides with palms facing forward.

Figure 7:
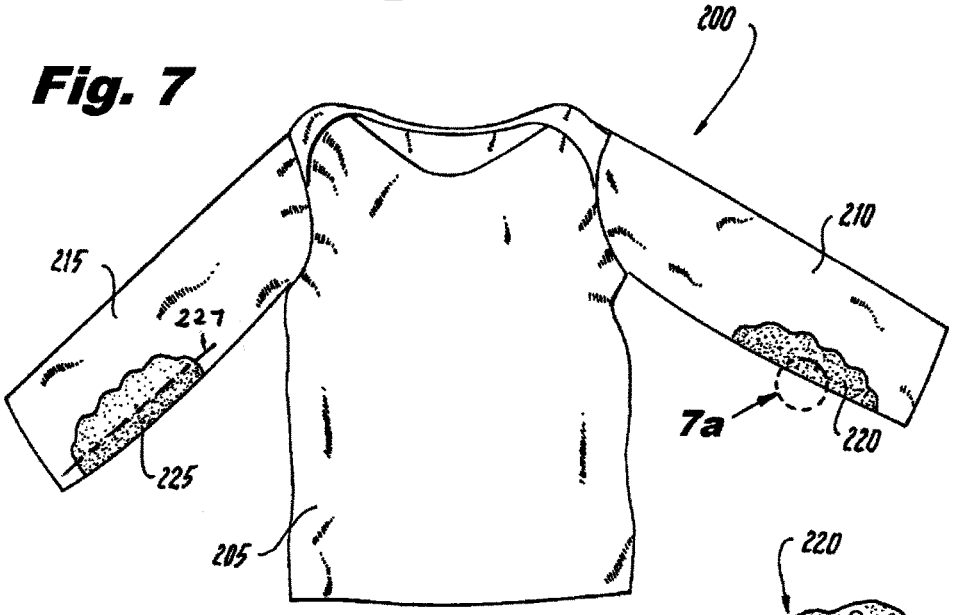
FIG. 7 shows a front elevational view of a shirt in accordance with an illustrative embodiment of the invention.

The illustrative embodiments set forth herein provide garments that aid an infant in achieving a stable quadruped posture as well as controlled mobility by crawling and creeping. FIG. 6 shows a front elevational view of pants 100 in accordance with an illustrative embodiment of the invention. FIG. 7, in turn, shows a front elevational view of a corresponding shirt 200 according to an illustrative embodiment of the invention. It should be recognized, however, that while the pants 100 and the shirt 200 are set forth as separate elements, aspects of the invention may be applied to a unitary garment wherein the pants 100 are attached to the shirt 200. Such a unified garment may be referred to as a "onesie" when applied to clothing for infants.

The pants 100 in FIG. 6 may be conceptually separated into a left pant half 105 and a right pant half 110. Three distinct left pant patches overlie respective portions of the left pant half 105: an upper left pant patch 115-1, a middle left pant patch 115-2, and a lower left pant patch 115-3 (collectively "the left pant patches 115"). Likewise, three distinct right pant patches overlie respective portions of the right pant half 110: an upper right pant patch 120-1, a middle right pant patch 120-2, and a lower right pant patch 120-3 (collectively "the right pant patches 120"). In this particular illustrative embodiment, the left pant patches 115 and the right pant patches 120 are elongate and describe wave-like margins, suggesting the shapes of clouds. At the same time, each of the left and right pant patches 115, 120 describes a respective longitudinal axis that is oriented in a superior-medial to inferior-lateral direction when the pants 100 are worn. That is the left and right pant patches 115, 120 are obliquely oriented with respect to the pants 100. A representative longitudinal axis 122 is shown in FIG. 6 for middle right pant patch 120-2.

The shirt 200 in FIG. 7 may also be conceptually separated into different portions, in this case: a shirt center 205, a left shirt sleeve 210, and a right shirt sleeve 215. A left shirt patch 220 overlies a portion of the forearm of the left shirt sleeve 210. Likewise, a right shirt patch 225 overlies a portion of the forearm of the right shirt sleeve 215. Like the left and right pant patches 115, 120, the left shirt patch 220 and the right shirt patch 225 are elongate and define wave-like margins. However, unlike the left and right pant patches 115, 120, the left and right shirt patches 220, 225 each have a respective longitudinal axis that runs in a superior-inferior direction when the shirt 200 is worn. A representative longitudinal axis 227 is shown in FIG. 7 for right shirt patch 225.

When donned by a wearer, the upper left pant patch 115-1 and the upper right pant patch 120-1 preferably overlie the left and right hips (pelvis) of the wearer, respectively, while the middle left pant patch 115-2 and the middle right pant patch 120-2 preferably overlie the left and right thighs of the wearer, respectively. The lower left pant patch 115-3 and the lower right pant patch 120-3 preferably overlie the left and right anterior shins of the wearer, respectively. While the shirt is worn by the wearer, the left shirt patch 220 and the right shirt patch 225 preferably overlie the left and right forearms of the wearer, respectively. That said, it should be recognized that these cited positions for the patches 115, 120, 220, 225 are by way of preferred example, and alternative positioning of the patches may fall within the scope of the invention.

Figure 7A:
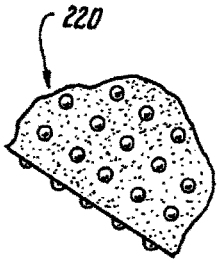
FIG. 7*a* shows a magnified front elevational view of a portion of a left shirt patch in FIG. 7.
Figure 10:
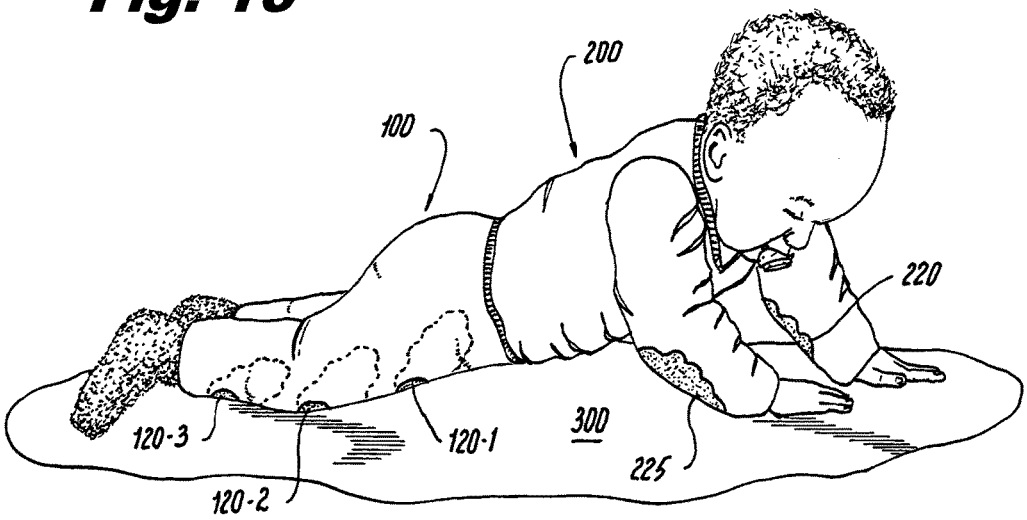
FIG. 10 shows a perspective view of an infant in a third intermediate posture wearing the garments in FIGS. 6 and 7.

At the same time, both the left and right pant patches 115, 120 and the left and right shirt patches 220, 225 are preferably formed of a material that exhibits a relatively high coefficient of static friction with common household floor surfaces (i.e., ground surfaces) such as, for example, finished wood and tile. More particularly, for a given ground surface, each of the patches 115, 120, 220, 225 is preferably characterized by a coefficient of static friction with the ground surface greater than that for the respective portion of the left or right pant half 105, 110 or left or right shirt sleeve 210, 215 that underlies it. In one or more embodiments, for example, the patches 115, 120, 220, 225 may comprise a texturized rubber material that is adhered to the underlying pants 100 and the underlying shirt 200 utilizing a temperature-activated (e.g., iron-on) adhesive. Such an embodiment is shown in FIG. 6*a*, which shows a magnified front elevational view of a portion of the middle left pant patch 115-2 from the pants 100 in FIG. 6. Likewise, FIG. 7*a* shows a magnified front elevational view of a portion of the left shirt patch 220 from the shirt 200 in FIG. 7. Of course, in alternative embodiments, the patches 115, 120, 220, 225 may be adhered to the garments by other fixation means such as thread, rivets, etc.

It is difficult to ascertain comparative values for coefficients of static friction related to fabrics and rubber with similar surfaces from the literature since these values are very condition specific. That said, cotton on steel appears to have a coefficient of static friction near 0.3, while the coefficient for "rubber on solids" is frequently reported as falling between one and four. Such values suggest that rubber exhibits a higher coefficient of static friction with most solid materials than does cotton fabric. Accordingly, it is expected, and it is the inventor's empirical experience, that texturized rubber patches applied to cotton garments provide significantly greater frictional forces with common household surfaces such as finished wood floors and tile than garments without the rubber patches.

With the increased frictional forces developed by the patches 115, 120, 220, 225, an infant wearing the pants 100 and the shirt 200 gains significant advantages with respect to achieving and maintaining stable quadruped posture and controlled, efficient early mobility. FIGS. 8-11 show perspective views of an infant in the first intermediate, the second intermediate, the third intermediate, and the quadruped posture, respectively, while the infant is wearing the illustrative pants 100 and the shirt 200 described above. In each of the figures, the infant is positioned on a ground surface 300. At the same time, for purposes of description, portions of the various patches 115, 120, 220, 225 are illustrated with dashed lines in FIGS. 8 and 10 where they would not normally be visible in order to better illustrate their contact with the underlying ground surface 300.

FIG. 9*a*, moreover, shows a sectional view of the contact region between the right shirt patch 225 and the ground surface 300 along the plane indicated in FIG. 9. In FIG. 9*a*, one may see the fabric of the right sleeve half 215 (e.g., cotton) positioned over the right sleeve patch 225 (e.g., texturized rubber). The right sleeve patch 225, in turn, is in contact with the ground surface 300 (e.g., finished wood or tile). The downward force of the infant's body is thereby converted into a friction force between the right sleeve patch 225 and the ground surface 300. This friction force may be proportional to the downward force multiplied by the coefficient of static friction. A similar friction force is developed at each position where one of the patches 115, 120, 220, 225 contacts the ground surface 300 in FIGS. 8-11.

Figure 1:
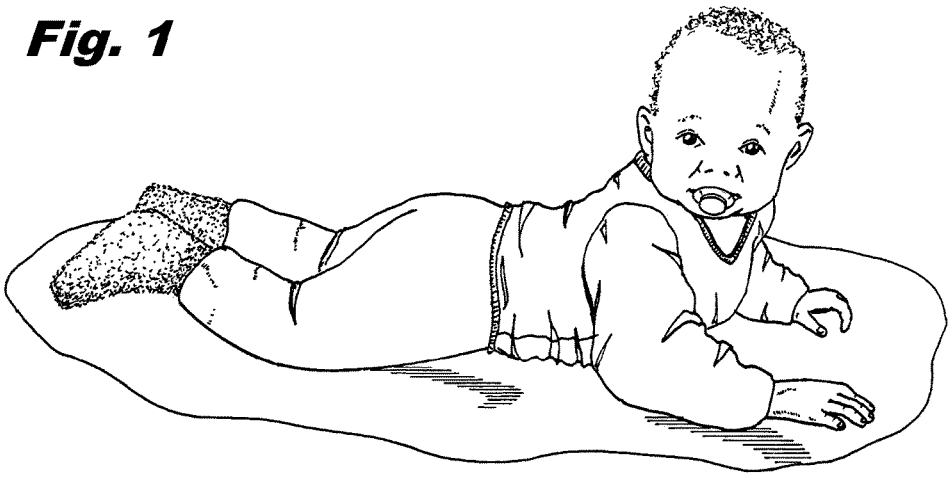
FIG. 1 shows a perspective view of an infant in a first intermediate posture.
Figure 2:
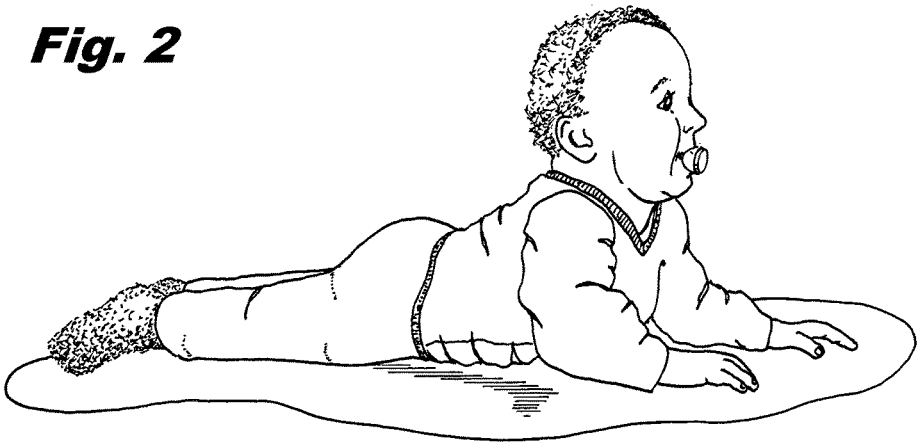
FIG. 2 shows a perspective view of an infant in a second intermediate posture.
Figure 3:
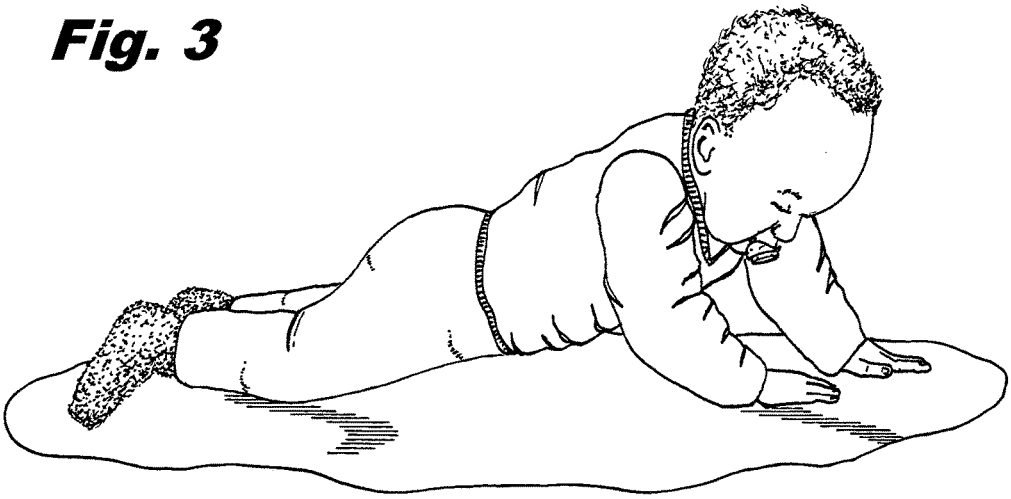
FIG. 3 shows a perspective view of an infant in a third intermediate posture.
Figure 4:
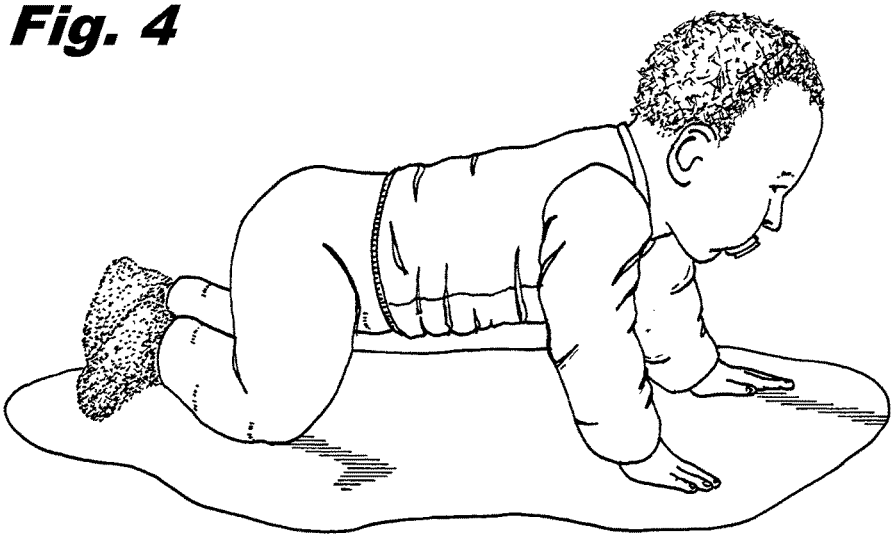
FIG. 4 shows a perspective view of an infant in a quadruped posture.
Figure 5:
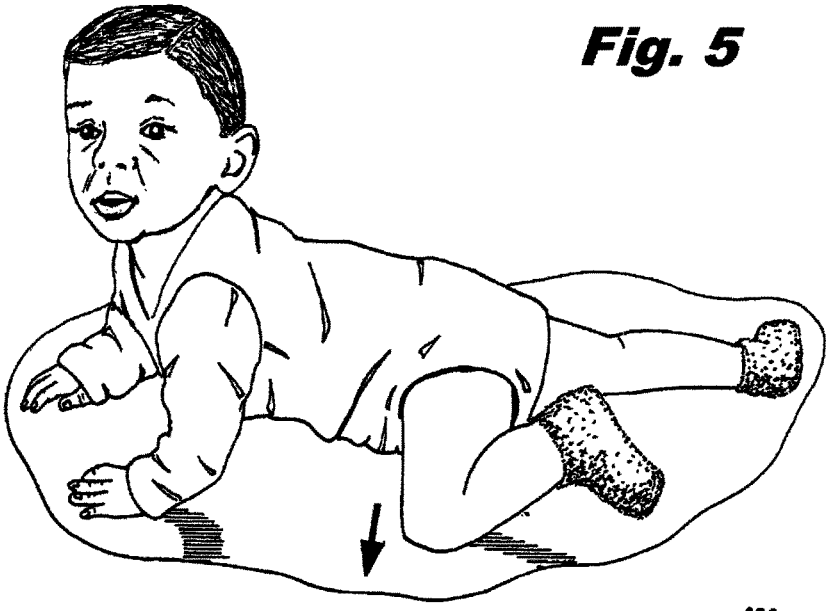
FIG. 5 shows a perspective view of an infant in an immature quadruped posture.
Figure 11:
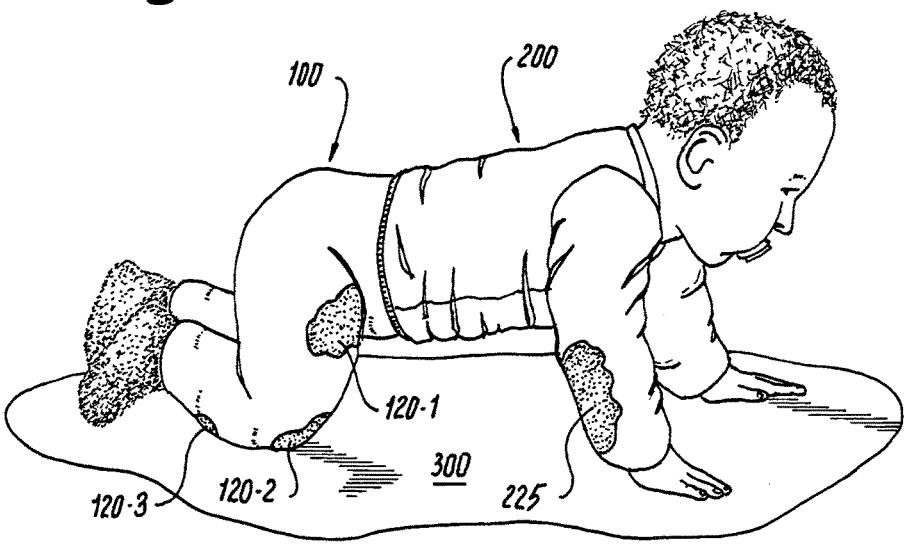
FIG. 11 shows a perspective view of an infant in a quadruped posture wearing the garments in FIGS. 6 and 7.

In the first intermediate and the second intermediate postures (FIGS. 8 and 9), the left and right shirt patches 220, 225, as well as the left and right pant patches 115, 120, contact the ground surface 300. As the infant transitions through the third intermediate posture (FIG. 10) to the quadruped posture (positioning on hands and knees; FIG. 11), the left and right shirt patches 220, 225 and the upper left and upper right pant patches 115-1, 120-1 are elevated above the ground surface 300, but the middle and lower left and right pant patches 115-2, 115-3, 120-2, 120-3 continue to stay in contact. In so doing, the patches 115, 120, 220, 225 provide optimal frictional coupling between the wearer's posture- and locomotion-related muscles and the ground surface 300. The specific design and angled orientation of the illustrative left and right pant patches 115, 120, for example, frictionally couple the hip flexors, hip-adductors/internal-rotators, and the anterior tibial (shin) compartment muscle groups to the ground surface 300 so as to allow these muscle groups to more effectively work together to bring the legs into an improved midline hand-and-knee alignment necessary for maintaining a mature quadruped posture (FIG, 11). The unique design and orientation of the left and right pant patches 115, 12.0 thereby encourage a transition from an immature quadruped posture (FIG. 5) toward a more mature quadruped midline orientation, as demonstrated by bringing lower extremities into hip adduction, hip internal rotation, and knee flexion (about 90 degrees) towards a mature midline quadruped posture.

At the same time, the enhanced stability provided by the pant patches 115, 120 also encourages controlled mobility as demonstrated by the dissociation of legs and arms required for motor control during crawling and creeping mechanics. That is, the pant patches 115, 120 also provide the wearer with the enhanced stability required to shift his weight onto one side while simultaneously freeing an opposite limb. This kind of reciprocal motion is a precursor to reciprocal creeping, plantigrade creeping (i.e., locomotion on hands and feet), transitioning from floor to standing via half kneel, and, ultimately, healthy upright walking with reciprocal arm swings. In addition, the enhanced stability reduces frustration and improves transitional movement success for children when attempting to crawl or creep, particularly when transitioning from a ground surface characterized by relatively high friction (e.g., carpeting) to one characterized by substantially lower friction (e.g., finished wood or tile). Notably, while the above-described benefits to both posture and locomotion provided by aspects of the invention will aid any child during typical motor development, they may also be of particular benefit to infants that lack stability and/or controlled mobility due to developmental disabilities such as Cerebral Palsy and Down Syndrome.

Having the left and right pant patches 115, 120 be divided into distinct portions (in this particular non-limiting, illustrative embodiment, three on each side) rather than be provided as one unitary patch on each pant half 105, 110 is preferred for several additional reasons. As indicated above, for example, the pant patches 115, 120 are preferably formed of a material with a high coefficient of static friction such as rubber. Nevertheless, a rubber material that is strong enough to withstand the rigors of the present application may be rather stiff The breaking up of the patches into distinct, separated pant patches 115, 120 on each pant half 105, 110 helps mitigate this stiffness, and thereby allows for better fluidity of movement when sequencing for crawling and creeping activities. In contrast, the wave-like margins of the patches 115, 120, 220, 225 as set forth above (described as being "cloud-like") are purely for aesthetics. Thus, when reduced to practice, the margins of the patches may take on any desired form, and the results will still come within the scope of the invention.

Several of the above-described advantages of aspects of the invention were directly observed by the inventor, who holds a doctorate degree in physical therapy and has been actively engaged in that field for many years. More specifically, the inventor clinically observed an infant of seven to nine months age more easily progress to a stable mature quadruped posture while wearing pants and a shirt similar to that shown in FIGS. 5 and 6 than without that clothing. She also observed that the same infant had a substantially easier time maintaining stability on somewhat slippery household surfaces such as finished wood and tile. In fact, she observed that the infant, while wearing the prototype pants and shirt, did not appear to have additional difficulty with stability on these slippery surfaces even when compared to carpeting.

It should again be emphasized that the above-described embodiments of the invention are intended to be illustrative only. Other embodiments can use different types and arrangements of elements for implementing the described functionality. For example, while the above-described embodiment set forth pants with three distinct pant patches on each pant half, alternative embodiments falling within the scope of the invention may utilize a very different number of distinct patches per side (e.g., two, four, five, etc.) Alternatively or additionally, while specific materials were set forth for the illustrative pants, shirt, and patches, equally suitable materials may also be utilized in their place when the invention is actually reduced to practice. These numerous alternative embodiments within the scope of the appended claims will be apparent to one skilled in the art.

Moreover, all the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

What is claimed is:

1. A garment for use by a wearer positioned on a ground surface, the garment comprising:

pants, the pants having a left pant half and a right pant half;

a plurality of left pant patches, each left pant patch of the plurality of left pant patches overlying a respective outside portion of the left pant half, and defining a respective discrete exposed surface that is elongate in shape and has, across the entire discrete exposed surface, a coefficient of static friction with the ground surface greater than that for the respective outside portion of the left pant half underlying the left pant patch; and a plurality of right pant patches, each right pant patch of the plurality of right pant patches overlying a respective outside portion of the right pant half, and defining a respective discrete exposed surface that is elongate in shape and has, across the entire discrete exposed surface, a coefficient of static friction with the ground surface greater than that for the respective outside portion of the right pant half underlying the right pant patch;

wherein a longitudinal axis of each left pant patch of the plurality of left pant patches is oriented in a superior-medial to inferior-lateral direction when the pants are worn by the wearer;

wherein a longitudinal axis of each right pant patch of the plurality of right pant patches is oriented in a superior-medial to inferior-lateral direction when the pants are worn by the wearer.

2. The garment of claim 1, wherein the plurality of left pant patches and the plurality of right pant patches comprise rubber.

3. The garment of claim 2, wherein the rubber is texturized.

4. The garment of claim 1, wherein:

each left pant patch of the plurality of left pant patches overlies a respective outside anterior portion of the left pant half when the pants are worn by the wearer; and each right pant patch of the plurality of right pant patches overlies a respective outside anterior portion of the right pant half when the pants are worn by the wearer.

5. The garment of claim 1, wherein:

the plurality of left pant patches consists of three distinct left pant patches in spaced relation to one another; and the plurality of right pant patches consists of three distinct right pant patches in spaced relation to one another.

6. The garment of claim 1, wherein:

the plurality of left pant patches comprises a left pant patch that is adapted to at least partially overlie a left hip of the wearer when the pants are worn by the wearer; and the plurality of right pant patches comprises a right pant patch that is adapted to at least partially overlie a right hip of the wearer when the pants are worn by the wearer.

7. The garment of claim 1, wherein:

the plurality of left pant patches comprises a left pant patch that is adapted to at least partially overlie a left thigh of the wearer when the pants are worn by the wearer; and the plurality of right pant patches comprises a right pant patch that is adapted to at least partially overlie a right thigh of the wearer when the pants are worn by the wearer.

8. The garment of claim 1, wherein:

the plurality of left pant patches comprises a left pant patch that is adapted to at least partially overlie a left shin of the wearer when the pants are worn by the wearer; and the plurality of right pant patches comprises a right pant patch that is adapted to at least partially overlie a right shin of the wearer when the pants are worn by the wearer.

9. The garment of claim 1, further comprising:

a shirt, the shirt defining a left shirt sleeve and a right shirt sleeve;

a left shirt patch, the left shirt patch overlying an outside portion of the left shirt sleeve, being elongate, and being characterized by a coefficient of static friction with the ground surface greater than that for the outside portion of the left shirt sleeve underlying it; and a right shirt patch, the right shirt patch overlying an outside portion of the right shirt sleeve, being elongate, and being characterized by a coefficient of static friction with the ground surface greater than that for the outside portion of the right shirt sleeve underlying it.

10. The garment of claim 9, wherein:

a majority of the left shirt patch is adapted to overlie a left forearm of the wearer when the shirt is worn by the wearer; and a majority of the right shirt patch is adapted to overlie a right forearm of the wearer when the shirt is worn by the wearer.

11. The garment of claim 9, wherein:

a longitudinal axis of the left shirt patch is oriented in a superior to inferior direction when the shirt is worn by the wearer; and a longitudinal axis of the right shirt patch is oriented in a superior to inferior direction when the shirt is worn by the wearer.

12. A garment for use by a wearer positioned on a ground surface, the garment comprising:

pants, the pants having a left pant half and a right pant half;

a plurality of left pant patches, each left pant patch of the plurality of left pant patches overlying a respective outside portion of the left pant half, and defining a respective discrete exposed surface that is elongate in shape and has, across the entire discrete exposed surface, a coefficient of static friction with the ground surface greater than that for the respective outside portion of the left pant half underlying the left pant patch;

a plurality of right pant patches, each right pant patch of the plurality of right pant patches overlying a respective outside portion of the right pant half, and defining a respective discrete exposed surface that is elongate in shape and has, across the entire discrete exposed surface, a coefficient of static friction with the ground surface greater than that for the respective outside portion of the right pant half underlying the right pant patch;

a shirt, the shirt defining a left shirt sleeve and a right shirt sleeve;

a left shirt patch, the left shirt patch overlying an outside portion of the left shirt sleeve, being elongate, and being characterized by a coefficient of static friction with the ground surface greater than that for the outside portion of the left shirt sleeve underlying it; and a right shirt patch, the right shirt patch overlying an outside portion of the right shirt sleeve, being elongate, and being characterized by a coefficient of static friction with the ground surface greater than that for the outside portion of the right shirt sleeve underlying it;

wherein a longitudinal axis of each left pant patch of the plurality of left pant patches is oriented in a superior-medial to inferior-lateral direction when the pants are worn by the wearer; and wherein a longitudinal axis of each right pant patch of the plurality of right pant patches is oriented in a superior-medial to inferior-lateral direction when the pants are worn by the wearer.

13. The garment of claim 12, wherein the shirt is attached to the pants to form a unitary garment.

14. The garment of claim 1, wherein at least one left pant patch of the plurality of left pant patches comprises an irregular border.

15. The garment of claim 1, wherein at least one right pant patch of the plurality of right pant patches comprises an irregular border.

* * * * *